US008555441B2

(12) United States Patent
Fraser

(10) Patent No.: US 8,555,441 B2
(45) Date of Patent: Oct. 15, 2013

(54) THERAPEUTIC MATTRESS SYSTEM AND METHODS OF FABRICATING SAME

(75) Inventor: Kevin Gerard Fraser, Belleville, IL (US)

(73) Assignee: Star Cushion Products, Inc., Freeburg, IL (US)

( * ) Notice: Subject to any disclaimer, the term of this patent is extended or adjusted under 35 U.S.C. 154(b) by 283 days.

(21) Appl. No.: 12/760,328

(22) Filed: Apr. 14, 2010

(65) Prior Publication Data

US 2011/0252570 A1 Oct. 20, 2011

(51) Int. Cl.
*A47C 27/08* (2006.01)

(52) U.S. Cl.
USPC ..... 5/713; 5/710; 5/706

(58) Field of Classification Search
USPC ..... 5/713, 710, 654, 655.3
See application file for complete search history.

(56) References Cited

U.S. PATENT DOCUMENTS

| | | | | |
|---|---|---|---|---|
| 3,587,568 | A | 6/1971 | Thomas | |
| 3,674,019 | A | 7/1972 | Grant | |
| 3,870,450 | A | 3/1975 | Graebe | |
| 4,005,236 | A | 1/1977 | Graebe | |
| 4,175,297 | A | 11/1979 | Robbins et al. | |
| 4,225,989 | A | 10/1980 | Corbett et al. | |
| 4,541,136 | A | 9/1985 | Graebe | |
| 4,551,874 | A | 11/1985 | Matsumura et al. | |
| 4,617,690 | A | 10/1986 | Grebe | |
| 4,698,864 | A | 10/1987 | Graebe | |
| 4,864,671 | A | 9/1989 | Evans | |
| 5,105,488 | A | 4/1992 | Hutchinson et al. | |
| 5,163,196 | A | 11/1992 | Graebe et al. | |
| 5,369,828 | A | 12/1994 | Graebe | |
| 5,502,855 | A | 4/1996 | Graebe | |
| 5,551,107 | A | 9/1996 | Graebe | |
| D391,434 | S | 3/1998 | Denney et al. | |
| D395,780 | S | 7/1998 | Denney et al. | |
| 6,189,168 | B1 | 2/2001 | Graebe | |
| 6,687,937 | B2 | 2/2004 | Harker | |
| 7,086,104 | B1 | 8/2006 | Tsay | |
| 2005/0081300 | A1 | 4/2005 | O'Reagan et al. | |
| 2007/0070684 | A1 * | 3/2007 | Poulos | 365/149 |
| 2007/0113351 | A1 | 5/2007 | Reger et al. | |
| 2007/0113352 | A1 * | 5/2007 | Poulos | 5/727 |

OTHER PUBLICATIONS

An International Preliminary Report on Patentability, dated Apr. 30, 2013, for co-pending International application No. PCT/US2011/032112.

* cited by examiner

*Primary Examiner* — Peter M Cuomo
*Assistant Examiner* — Brittany Wilson
(74) *Attorney, Agent, or Firm* — Armstrong Teasdale LLP

(57) ABSTRACT

A cellular structure includes a base, a plurality of hollow cells coupled to the base, a sealing layer, and a pressurization system. The base includes at least a first layer and a second layer. The cells each extend outwardly from the base, and are grouped together in at least a first zone, a second zone, and a third zone. The cells in each of the first, second, and third zones are only coupled in flow communication with the cells in that respective zone. The pressurization system is coupled to the first, second, and third zones for selectively and independently pressurizing each of the zones. The pressurization zone is configured such that in a first mode of operation, the first zone is pressurized and the second and third zones are depressurized, and in a second mode of operation, the first zone is depressurized while the second and third zones are pressurized.

33 Claims, 7 Drawing Sheets

FIGURE 6

300

| | VALVE1 | | VALVE2 | |
|---|---|---|---|---|
| SEGMENTS | A SECTION | B SECTION | C SECTION | D SECTION |
| 1 | 1 | 1 | 0 | 0 |
| 2 | 0 | 1 | 1 | 0 |
| 3 | 1 | 0 | 1 | 0 |
| 4 | 1 | 0 | 0 | 1 |
| 5 | 0 | 0 | 1 | 1 |
| 6 | 0 | 1 | 1 | 0 |
| 7 | 0 | 1 | 0 | 1 |
| 8 | 1 | 0 | 0 | 1 |
| 9 | 1 | 1 | 0 | 0 |
| 10 | 0 | 1 | 0 | 1 |
| 11 | 0 | 0 | 1 | 1 |
| 12 | 1 | 0 | 1 | 0 |

FIGURE 7

300

| | VALVE1 | | VALVE2 | |
|---|---|---|---|---|
| SEGMENTS | A | B | C | D |
| 1 | 0 | 1 | 1 | 0 |
| 2 | 1 | 0 | 1 | 0 |
| 3 | 1 | 0 | 0 | 1 |
| 4 | 0 | 1 | 0 | 1 |
| 5 | 0 | 1 | 1 | 0 |
| 6 | 1 | 0 | 1 | 0 |
| 7 | 1 | 0 | 0 | 1 |
| 8 | 0 | 1 | 0 | 1 |

FIGURE 8

300

| | VALVE1 | | VALVE2 | |
|---|---|---|---|---|
| SEGMENTS | A | D | B | C |
| 1 | 1 | 0 | 1 | 0 |
| 2 | 1 | 0 | 0 | 1 |
| 3 | 0 | 1 | 0 | 1 |
| 4 | 0 | 1 | 1 | 0 |
| 5 | 1 | 0 | 1 | 0 |
| 6 | 0 | 1 | 1 | 0 |
| 7 | 0 | 1 | 0 | 1 |
| 8 | 1 | 0 | 0 | 1 |

FIGURE 9

300

| | VALVE1 | | VALVE2 | |
|---|---|---|---|---|
| SEGMENTS | A | C | B | D |
| 1 | 1 | 0 | 1 | 0 |
| 2 | 0 | 1 | 1 | 0 |
| 3 | 1 | 0 | 0 | 1 |
| 4 | 0 | 1 | 0 | 1 |
| 5 | 0 | 1 | 1 | 0 |
| 6 | 1 | 0 | 0 | 1 |
| 7 | 1 | 0 | 1 | 0 |
| 8 | 0 | 1 | 0 | 1 |

THERAPEUTIC MATTRESS SYSTEM AND METHODS OF FABRICATING SAME

BACKGROUND OF THE INVENTION

This invention relates generally to therapeutic mattress systems, and more particularly, to inflatable cellular mattress systems that use dynamic pressure control systems.

Individuals who are confined to wheelchairs and/or who are confined to a bed may run the risk of tissue breakdown and the development of pressure sores, which are extremely dangerous and difficult to cure. More specifically, as such individuals are primarily in a seated position for extended periods of time, their weight may be concentrated in the bonier portions of the individual's buttocks, for example. Over time, blood flow to such areas may decrease, causing tissue to break down in these areas. The problems may be further exacerbated when individuals are confined to a bed or are required to remain in a prone position for an extended period of time.

To facilitate reducing the weight concentration of such individuals, at least some users seated in at least some known wheelchairs and/or confined to a bed, use cellular structures to facilitate distributing the individual's weight over a larger area, and to facilitate decreasing their weight concentration in smaller areas. More specifically, in at least some known cellular structures, because the plurality of air-filled cells are coupled in flow communication through the base, the internal pressure exerted by the air within such cells is at the same pressure throughout the plurality of cells, and as such, each cell exerts the same pressure against the portion of the individual in contact with the structure. To increase the stability and comfort level of the user, at least some known cellular structures are divided into isolated zones of cells, wherein the cells of each zone are only coupled in flow communication with the cells within their zone. By varying the pressure between the isolated zones, the user may be able to increase their stability on the cellular cushion depending on the physical condition of the user. For example, U.S. Patent Application 2007/00707684 describes an inflatable cellular mattress in which the mattress cells are divided into two large zones of cells. Each zone of cells includes an inlet valve and an exhaust valve that enables the pressure in each zone of cells to be altered independently of the pressure in the cells in the adjoining zone. Dividing the cells into two zones enables a concentrated pressure to be selectively induced to the patient. Specifically, and as described in U.S. Pending Patent Application 2007/00707684, for example, alternating the pressure in the two zones of cells induces percussive forces to the patient that are roughly equivalent to the force a nurse would induce to a patient to break loose phlegm from the walls of the lungs by beating on the patient's back in the lung area. Moreover, within mattresses such as this, if any cell in either zone develops a leak, air may leak from all of the cells within that zone.

BRIEF DESCRIPTION OF THE INVENTION

In one embodiment, a cellular structure is provided. The cellular structure includes a base, a plurality of hollow cells coupled to the base, a sealing layer, and a pressurization system. The base includes at least a first layer and a second layer. The plurality of hollow cells each extend outwardly from the base. The plurality of cells are grouped together in at least a first zone, a second zone, and a third zone, wherein the plurality of cells in each of the first, second, and third zones are only coupled in flow communication with the plurality of cells in that respective zone. The sealing layer is coupled to at least one of the base first and second layers. The pressurization system is coupled to the first, second, and third zones for selectively pressurizing each of the zones independently of cells coupled in the other zones. The pressurization zone is configured such that in at least a first mode of operation, the first zone is pressurized while the second and third zones are depressurized, and such that in at least a second mode of operation, the first zone is depressurized while the second and third zones are pressurized.

In another embodiment, a cellular cushion including a base, and a plurality of hollow cells coupled to the base is provided. The base includes at least a first layer and a second layer. The plurality of hollow cells extend outwardly from the base. The plurality of cells are grouped together in at least three independent zones such that the plurality of cells in each of the three independent zones are only coupled in flow communication with the plurality of cells in that respective zone. Each of the zones includes a plurality of clusters of cells that are coupled together in flow communication. The clusters are arranged in a spaced pattern extending across the cushion wherein each of the clusters in the first zone are adjacent to each of the clusters in the second and third zones within the spaced pattern.

In a further aspect, a cellular mattress including a flexible base and a plurality of zones of hollow cells is provided. The flexible base includes a plurality of layers. The plurality of zones of hollow cells are coupled to the base in a pattern that includes at least a first zone, a second zone, and a third zone of cells. The cells in the first zone are only coupled in flow communication with cells in the first zone, the cells in the second zone are only coupled in flow communication with cells in the second zone, and the cells in the third zone are only coupled in flow communication with cells in the third zone. The cells in each of the zones are arranged in a spaced pattern such that cells in the first zone are adjacent to cells in the second and third zones, and such that a portion of the first zone is between a portion of the second and third zones.

In yet another aspect, a cellular mattress including a base, a plurality of hollow fluid-containing cells, and a plurality of manifolds is provided. The base includes at least one layer. The plurality of hollow fluid-containing cells are coupled to the base such that the cells are coupled together in flow communication in a plurality of zones of cells. Each of the cells extends outwardly from the base. A cavity defined within each cell in each of the zones is coupled in flow communication only with every other cell cavity in that respective zone. The plurality of manifolds are coupled to the base to enable a fluid pressure within the mattress to be selectively changed. The plurality of manifolds include at least a first manifold coupled to the first zone for controlling a fluid pressure of the cells within the first zone independently of cells in the second and third zones, a second manifold coupled to the second zone for controlling a fluid pressure of the cells within the second zone independently of cells in the first and third zones, and a third manifold coupled to the third zone for controlling a fluid pressure of the cells within the third zone independently of cells in the first and second zones.

In a further aspect, a method of fabricating a cellular mattress is provided. The method includes forming a first base layer including a plurality of hollow cells that extend outwardly from the base, wherein the cells are coupled together in flow communication in one of a first zone, a second zone, and a third zone. The method also includes coupling a second layer to the first layer, such that the cells in the first zone are coupled in flow communication only with cells in the first zone, such that the cells in the second zone are coupled in flow communication only with cells in the second zone, and such that cells in the third zone are coupled in flow communication only with cells in the third zone. In addition, the method also includes coupling at least one manifold to the base to enable a fluid pressure within the cells in the first zone to be controlled independently of the cells in the second and third zones, to enable a fluid pressure within the cells in the second zone to be controlled independently of the cells in the first and third zones, and to enable a fluid pressure within the cells in the third zone to be controlled independently of the cells in the first and second zones.

BRIEF DESCRIPTION OF THE DRAWINGS

FIGS. 6-9 are each logic diagrams of exemplary operating cycles that may be used with the manifold systems shown in FIGS. 4 and 5.

DETAILED DESCRIPTION OF THE INVENTION

Figure 1:
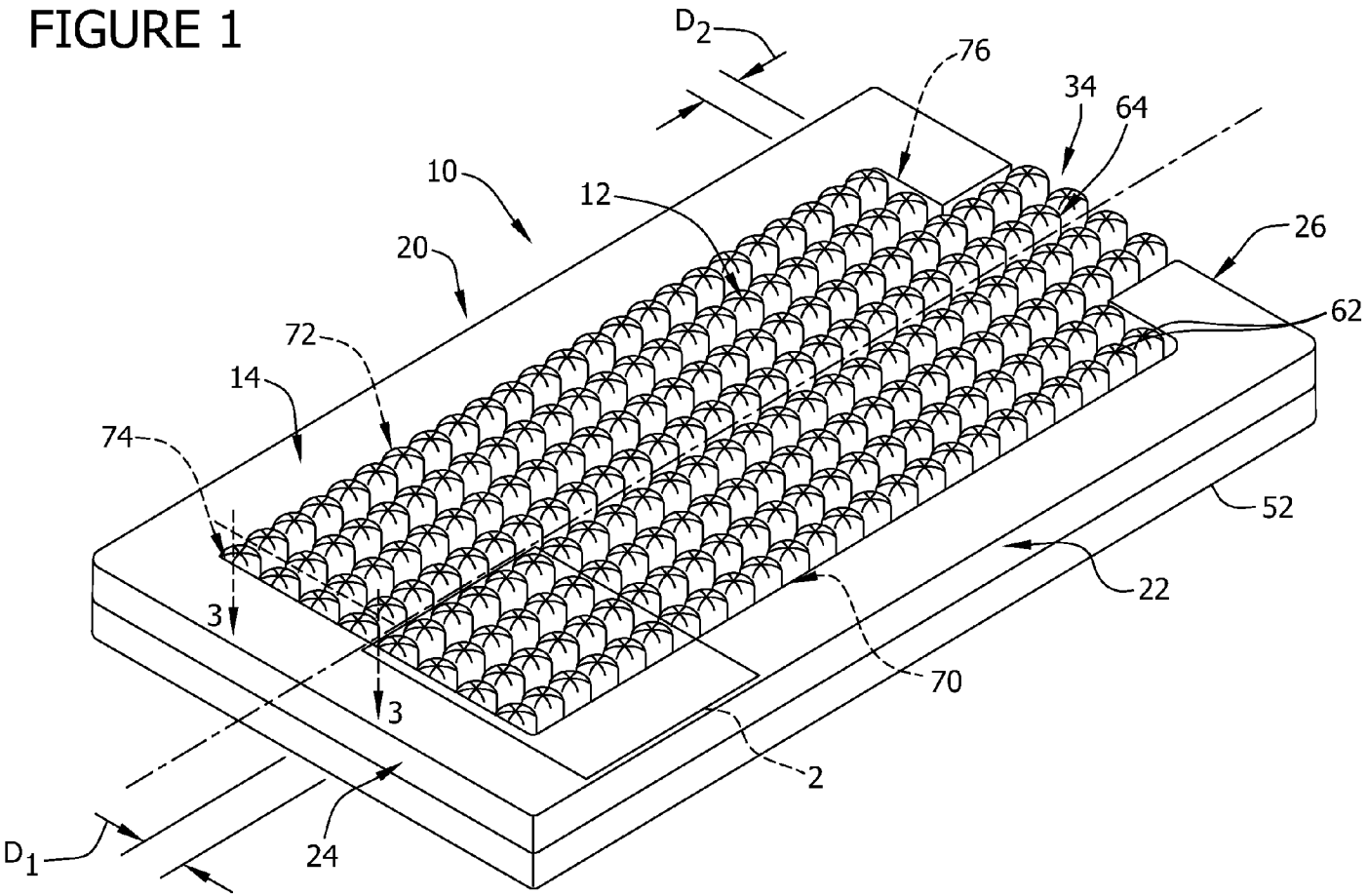
FIG. 1 is a perspective view of an exemplary inflatable cellular mattress.
Figure 2:
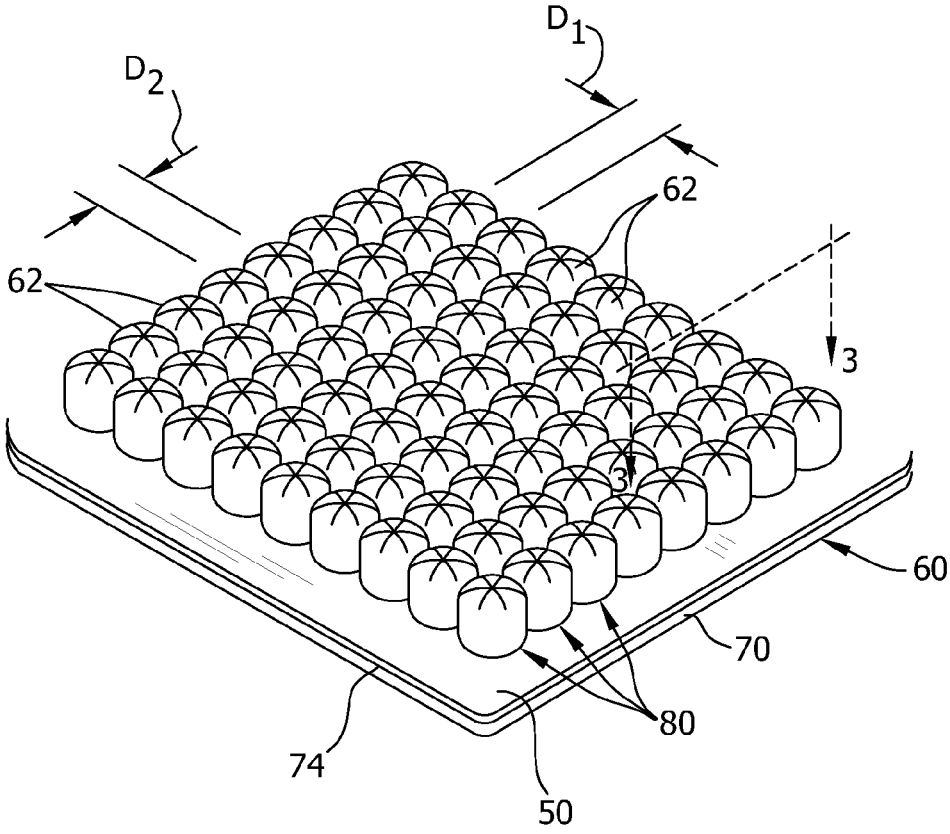
FIG. 2 is an enlarged perspective view of a portion of the mattress shown in FIG. 1 and taken along area 2.
Figure 3:
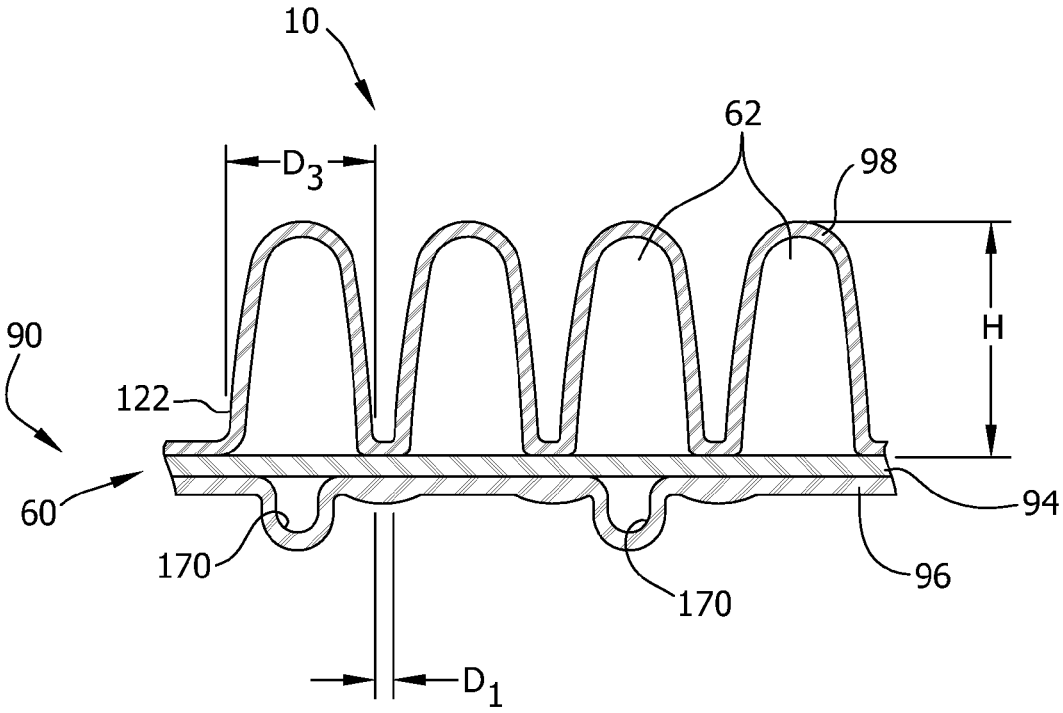
FIG. 3 is a cross-sectional view of a portion of the mattress shown in FIG. 2 and taken along line 3-3.
Figure 4:
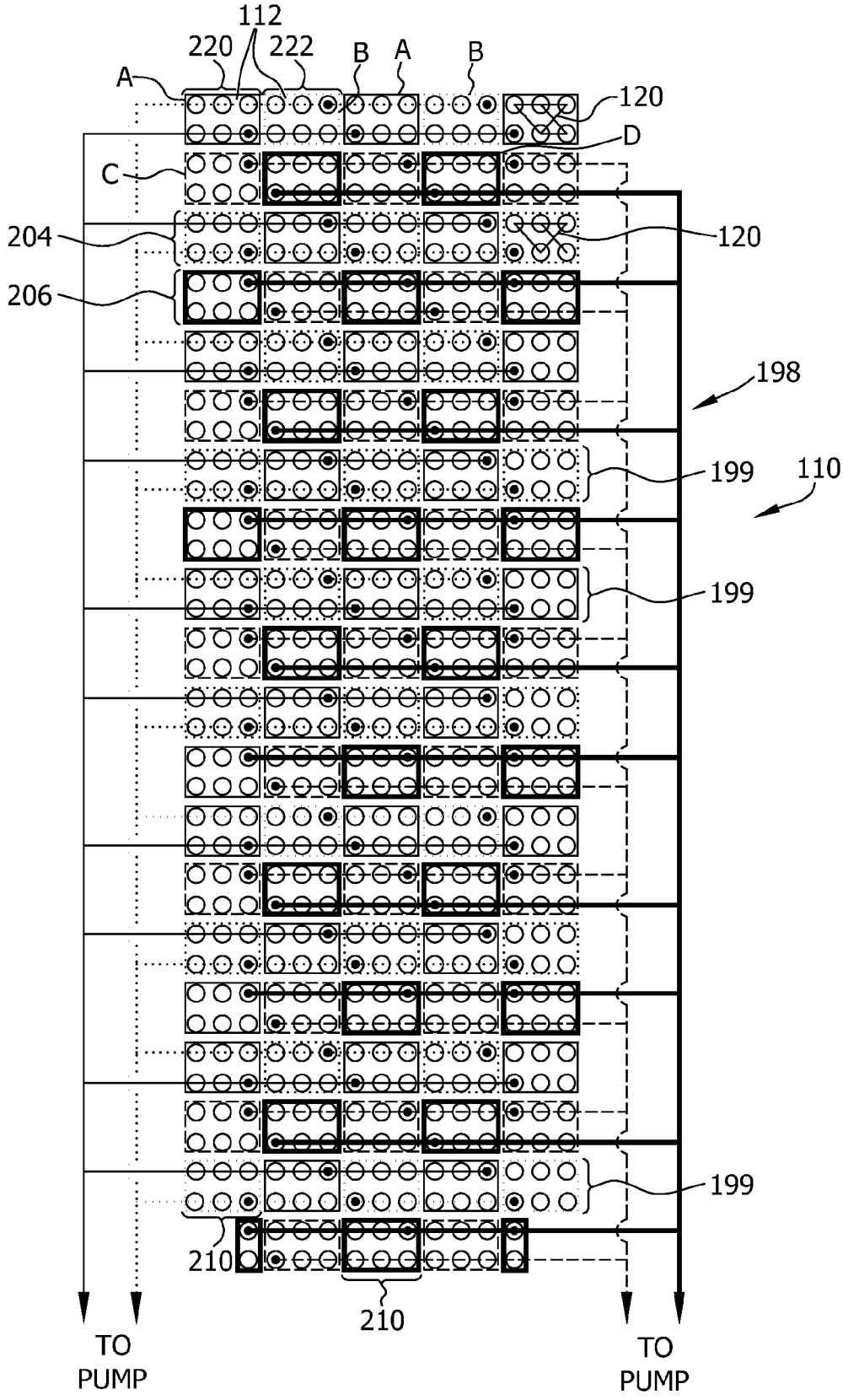
FIG. 4 is a schematic plan view of an exemplary manifold system that may be used with the mattress shown in FIG. 1.
Figure 5:
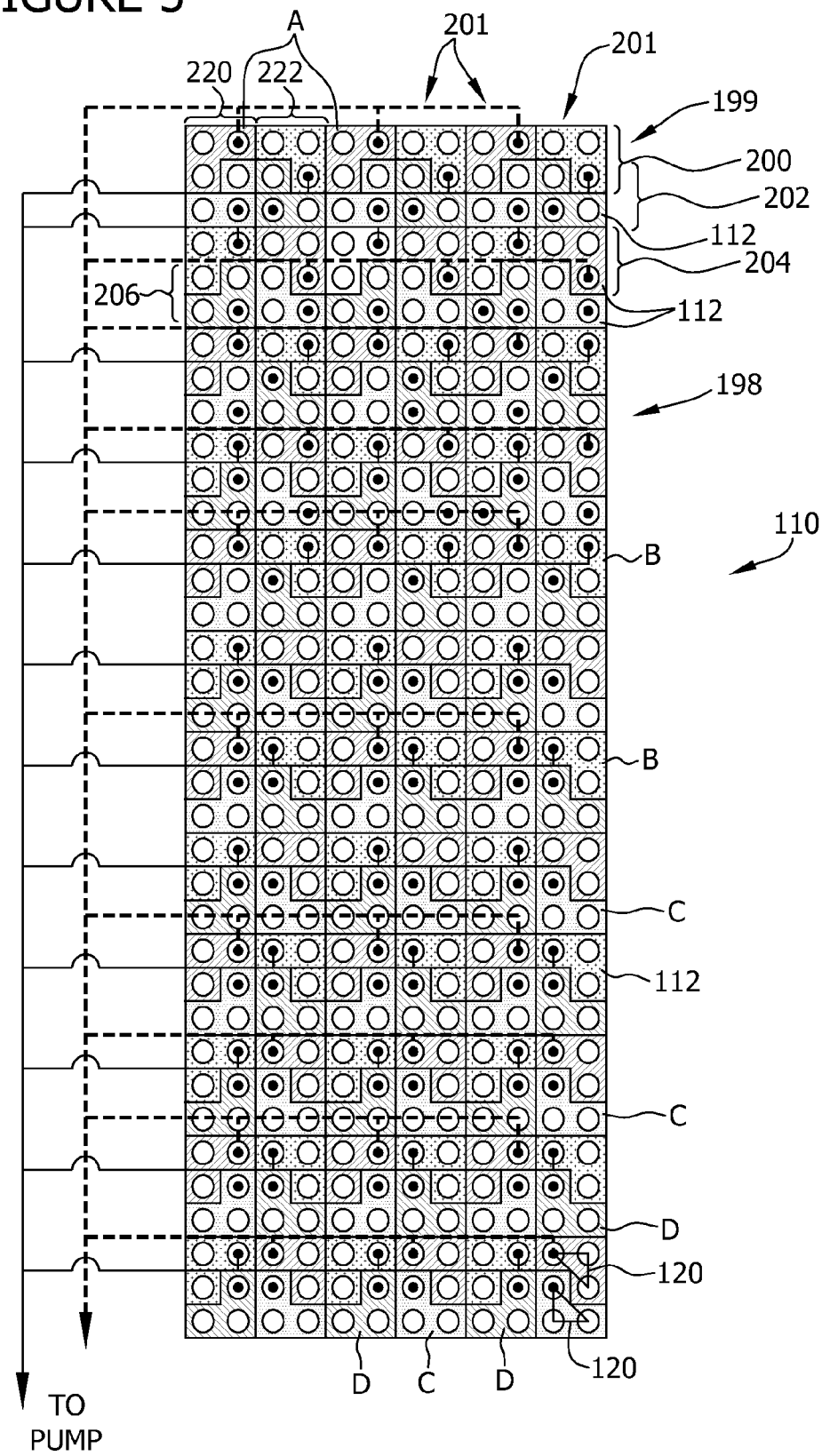
FIG. 5 is a schematic plan view of an alternative manifold system that may be used with the mattress shown in FIG. 1.

FIG. 1 is a perspective view of an exemplary inflatable cellular mattress 10. FIG. 2 is an enlarged perspective view of a portion of mattress 10 taken along area 2. FIG. 3 is a cross-sectional view of a portion of mattress 10 taken along line 3-3. FIG. 4 is a schematic plan view of an exemplary manifold system 11 that may be used with mattress 10. FIG. 5 is a schematic plan view of an alternative manifold system 13 that may be used with mattress 10. FIGS. 6-9 are each logic diagrams of exemplary operating cycles or operating schedules 300 that may be used with mattress 10. In the exemplary embodiment, mattress 10 includes an inflatable portion 12 and a non-inflatable portion 14. It should be noted that mattress 10 is illustrated as being sized to accommodate a user in a prone position, the technology described herein and associated with mattress 10 may be used in other cellular designs, including, but not limited to cushions used with wheelchairs, motorcycles, automobiles seating and/or office furniture.

In the exemplary embodiment, and as described in more detail below, inflatable portion 12 defines a "primary support area" of mattress 10 and non-inflatable portion 14 circumscribes or borders the majority of mattress 10 and thus forms an outer border of mattress 10. In other embodiments, non-inflatable portion 14 may circumscribe or border more or less of mattress 10 than is illustrated in FIG. 1. For example, in some embodiments, portion 14 may fully circumscribe inflatable portion 12. In other alternative embodiments, mattress 10 may not include non-inflatable portion 14.

In the exemplary embodiment, non-inflatable portion 14 is fabricated from a foam-like material that has an open cell structure that has a desired density and layer thickness to enable it to provide support to a person resting upon it. For example, in one embodiment, portion 14 is fabricated from generally rigid foam material that facilitates easing patient transfers. Alternatively, portion 14 may be fabricated from any material that enables mattress 10 to function as described herein. Moreover, in some embodiments, portion 14 may be fabricated to include at least one inflatable cell, that once inflated, has an air pressure that is generally maintained at a constant pressure, wherein the pressure in each cell is not adjustable by the user.

In the exemplary embodiment, non-inflatable portion 14 forms an outer border of mattress 10 and extends along opposite lateral sides 20 and 22 of mattress 10 and along at least a portion of the opposite axial sides 24 and 26 of mattress 10. In the exemplary embodiment, axial sides 24 and 26 form a head end and foot end, respectively, of mattress 10. More specifically, in the exemplary embodiment, portion 14 extends along mattress 10 between mattress sides 24 and 26, along each lateral side 24 and 26 of mattress 10, and along mattress 10 between mattress sides 20 and 22 along mattress head end 24. Moreover, in the exemplary embodiment, portion 14 extends only partially along mattress foot end 26 from each mattress axial side 20 and 22 at a foot end 26 of mattress 10. As such, in the exemplary embodiment, a gap 34 is defined within portion 14 along mattress foot end 26. More specifically, in the exemplary embodiment, inflatable portion 12, as described in more detail below, is sized and shaped to extend through gap 30 and forms a portion of the outer border of mattress 10 along mattress foot end 26. In other embodiments, portion 14 may be formed with any number of gaps 34 or any shape that enables mattress 10 to function as described herein. For example, in one embodiment, mattress 10 is substantially symmetrical and portion 14 extends only along each lateral side 24 and 26 of mattress 10.

In the exemplary embodiment, mattress 10 is generally flexible and as described herein, is configured for use on an underlying support surface, such as, but not limited to a chair seat, a mattress, or a box spring. Moreover, in the exemplary embodiment, inflatable portion 12 and non-inflatable portion 14 are integrated together as generally a single unit when mattress 10 is fully assembled. For example, in one embodiment, inflatable portion 12 is formed with a base support portion 50 that circumscribes inflatable portion 12 and that is coupled, via an adhesive, for example to a lower surface 52 of non-inflatable portion 14. In other embodiments, base support portion 50 is not coupled to surface 52, but rather support portion 50 is merely positioned against surface 52 such that non-inflatable portion 14 is sized to fit relatively snugly about inflatable portion 12 in a friction-fit type arrangement with inflatable portion 12. In another embodiment, non-inflatable portion surface 52 is sized to extend fully across mattress 10 between sides 24 and 26 and between sides 20 and 22.

In the exemplary embodiment, inflatable portion 12 includes a base 60 and a plurality of hollow cells 62. In the exemplary embodiment, base 60 is substantially planar and includes a foot portion 64 that extends outwardly from a substantially rectangular portion 66. Rectangular portion 66 is defined laterally by a pair of opposed sides 70 and 72 and axially by a pair of opposed sides 74 and 76. Alternatively, base 60 may be non-rectangular and/or may not include foot portion 64. In the exemplary embodiment, cells 62 are arranged in a plurality of substantially linear rows 80 that extend substantially generally axially across base 60 between sides 70 and 72. Moreover, in the exemplary embodiment, rows 80 are spaced substantially evenly across base 60 between sides 74 and 76. In an alternative embodiment, cells 62 may be arranged in other geometric configurations or orientations, and may not be arranged in rows 80. For example, in other embodiments, cells 60 may be oriented in any configuration that enables mattress 10 to function as described herein.

Base 60 is flexible and is formed from a plurality of layers 90 that are coupled together. In one embodiment, base 60 and cells 62 are formed from a flexible neoprene. Alternatively, base 60 and cells 62 are formed from any material, including non-neoprene materials, which enables cellular mattress 10 to function as described herein. In the exemplary embodiment, a sealing layer 94, and an outer layer 96 are each coupled to a conformal layer 98 to form base 60, as described in more detail below. In one embodiment, at least one layer 94, 96, and/or 98 is fabricated from a material that prevents that specific layer 94, 96, and/or 98 from bonding against the other layers 94, 96, and/or 98. In an alternative embodiment, base 60 includes more or less than three layers 90.

In the exemplary embodiment, conformal layer 98 is formed unitarily with cells 62 and is coupled to upper sealing layer 94, such that cells 62 are coupled together in a multi-zoned arrangement 110 of cells 62. More specifically, and as described in more detail below, in the exemplary embodiment, arrangement 110 is a four-zoned system in which clusters 112 of cells 62 are coupled together in flow communication in each of four defined zones A, B, C, and D. Alternatively, clusters 112 of cells 62 could be coupled together in flow communication in more or less than four defined zones A, B, C, and/or D. For example, in one alternative embodiment, mattress 10 includes only three defined zones that include clusters 112 of cells 62 coupled together in flow communication.

In each arrangement 110, as described in more detail below, only those cells 62 in each respective zone A, B, C, or D are coupled together in flow communication, such that cells 62 included in any one zone A, B, C, or D are not coupled in flow communication with cells 62 included in any other zone A, B, C, or D. For example, clusters 112 of cells 62 included in zone A are only coupled in flow communication with other clusters 112 of cells 62 included in zone A, and are not coupled in flow communication with any cells 62 included in zones B, C, or D. In an alternative embodiment, layer 98 is formed in any arrangement 110 of cells 62 and/or any number of defined zones, such as A, B, C, or D, that enables mattress 10 to function as described herein.

In the exemplary embodiment, cells 62 are positioned substantially symmetrically within, and extending across, conformal layer 98. As such, in the exemplary embodiment, adjacent cells 62 within any row 80 are separated by a substantially equal distance $D_1$. Moreover, in the exemplary embodiment, adjacent rows 80 are separated by a substantially equal distance $D_2$. In an alternative embodiment, cells 62 in rows 80 and/or cells 62 in adjacent rows 80 are separated by variable distances. In another embodiment, cells 62 are not arranged in rows 80 and/or are not arranged symmetrically.

In the exemplary embodiment, conformal layer 98 is formed integrally with cells 62. For example, cells 98 may be molded integrally with layer 98. In another embodiment, cells 62 are coupled to layer 98 via a radio frequency welding process, for example. Alternatively, cells 62 may be formed integrally with layer 98 using any process, such as an injection molding process, for example, that enables mattress 10 to function as described herein. In the exemplary embodiment, cells 62 are all identical and each has an identical height H. For example, in one embodiment, each cell 62 has a height H equal to approximately 5 inches. Moreover, in the exemplary embodiment, each cell 62 has a substantially circular cross-sectional shape that is defined by a diameter $D_3$ at a base 122 of each cell 62. Alternatively, a plurality of different-sized cells may extend from base 60.

Sealing layer 94, in the exemplary embodiment, is approximately the same size as conformal layer 98, as defined by an outer perimeter of each of layers 94 and 98. In the exemplary embodiment, layer 94 is coupled to conformal layer 98 such that a plurality of channels 120 are defined between layers 94 and 98. Moreover, in the exemplary embodiment, sealing layer 94 is substantially planar and includes a plurality of openings 126 that, as described in more detail below, enable all cells 62 included in each particular zone A, B, C, and D to be selectively pressurized and depressurized during operation of mattress 10 through manifold systems 11 and/or 13. More specifically, and as described in more detail below, each manifold system 11 and 13 includes a plurality of supply/discharge channels 170 that couple clusters 112 included in each zone A, B, C, or D together in flow communication, such that only those clusters 112 included in that particular zone A, B, C, or D may be inflated and/or deflated independently of cells 62 included in the other zones A, B, C, or D.

More specifically, in the exemplary embodiment, channels 120 extend only between adjacent cells 62 defined in each cluster 112 of cells 62, and channels 170 extend only between the plurality of clusters 112 included within each respective zone A, B, C, or D, and the supply pumps (not shown). Accordingly, only the clusters 112 included within each respective zone A, B, C, or D, and more specifically, only the individual cells 62 within each of those clusters 112 included in that specific zone A, B, C, or D, are coupled together in flow communication. (For clarity purposes, only a portion of channels 120 are illustrated on FIGS. 4 and 5.) In an alternative embodiment, additional channels 120 extend between at least some of the clusters 112 included in a specific zone A, B, C, or D.

In the exemplary embodiment, channels 120 are formed as layer 94 is bonded to layer 98. For example, in one embodiment, layer 94 is vacuum formed to create channels 120. In another embodiment, polymers in layer 94 and/or 98 are coupled, via an RF welding process or a lamination process, for example, to either layer 94 or layer 98, prior to the two layers 94 and 98 being bonded or conjoined together. In another embodiment, an adhesive material is applied to layer 94 in selective locations that enable channels 120 to be formed as layers 94 and 98 are bonded together. In yet another embodiment, gaskets, such as rubber gaskets, are used to create channels 120.

In one embodiment, channels 120 are coupled to layer 94 using a silk screening process. In another embodiment, channels 120 are formed integrally with conformal layer 98. In a further embodiment, channels 120 are coupled to sealing layer 94 using a printing machine process. In yet another embodiment, channels 120 are coupled to layer 94 using an adhesive process. In a further embodiment, channels 120 are formed using a liquid gasket process. In another embodiment, channels 120 are formed using a spray process. Alternatively, channels 120 may be coupled to either layer 94 or layer 98 using any process that enables channels 120 to couple adjacent cells 62 in a specific cluster 112 in flow communication. For example, in an alternative embodiment, a rubber gasket may be coupled to layer 94 and/or layer 98 to form channels 120.

In the exemplary embodiment, a release agent is contained within each channel 120. The release agent facilitates ensuring that channels 120 remain substantially unobstructed during the assembly of mattress 10, such that adjacent cells 14 in each cluster 112 remain in fluid flow communication. More specifically, and as described in more detail below, during assembly of mattress 10, the release agent ensures that portions of adjacent cushion layers 94 and 98 remain separated in areas where channels 120 are defined. In the exemplary embodiment, the release agent is formed from a low viscous solution of talc powder and a carrier, such as, but not limited to alcohol, that is applied using a high volume, low pressure (HVLP) sprayer. In another embodiment, the release agent is any solution, such as, but not limited to, petroleum-based mixtures, that performs as described herein, and more specifically, prevents the bonding together of layers 94 and 98 in areas of channels 120, such that fluid flow between layers 94 and 98 is only possible through channels 120.

In the exemplary embodiment, after being bonded to conformal layer 98, sealing layer 94 is then coupled to outer layer 96. Outer layer 96, in the exemplary embodiment, is approximately the same size as sealing layer 94, as defined by an outer perimeter of each layer 94 and 96. Alternatively, outer layer 96 may be larger or smaller than sealing layer 94. More specifically, sealing layer 94 is coupled to outer layer 96 such that supply channels 170 are defined between layers 92 and 96. As described in more detail herein, supply channels 170 enable each particular zone A, B, C, and D to be selectively pressurized and depressurized during operation of mattress 10. More specifically, supply channels 170 couple each zone A, B, C, or D independently to a pressurization source, such as a supply pump, to enable only those cells 62 and those clusters 112 included in that particular zone A, B, C, or D to be selectively inflated/deflated independently of cells 62 coupled together in flow communication in the other zones A, B, C, or D.

In the exemplary embodiment, supply channels 170 can be formed similarly to the process used to form channels 120. For example, in one embodiment, sealing layer 94 is vacuum formed against outer layer 96 and is then bonded against outer layer 96 in each area on the surface of layer 96 that a supply channel 170 is not defined. As such, in such an embodiment, each supply channel 170 is bounded partially by layer 94 and partially by outer layer 96. Alternatively, supply channels 170 may be formed between layers 94 and 96, or against either layer 94 or 96 using any process that enables mattress 10 to function as described herein.

In the exemplary embodiment, mattress 10 includes four supply channels 170 that each extend between a supply pump and cells 62. Specifically, and as illustrated best in FIGS. 4 and 5, each zone A, B, C, and/or D is coupled in flow communication to a supply pump via a respective supply channel 170. For example, in the exemplary embodiment, zones A and B are each coupled to the same supply pump, i.e., the first pump, via a pair of supply channels 170, and zones C and D are each coupled to the same supply pump, i.e., the second pump, via a pair of supply channels 170. Alternatively, depending on the operating cycle (shown in FIGS. 6-9) being employed with mattress 10, zones A, B, C, and D may be coupled in different arrangements to the supply pumps. For example, in one alternative embodiment, zones A and D are coupled to the first supply pump, and zones B and C are coupled to the second supply pump.

The supply pumps, in the exemplary embodiment, are stand alone supply pumps that are coupled to mattress 10 via quick disconnect couplings (not shown). As a result, if a different operating cycle is desired, supply channels 170 may easily be interchanged. In one embodiment, the supply pumps may be, but are not limited to being, alternating air pressure pumps. In another embodiment, at least one of the pumps may include an optional blower that facilitates low air loss from mattress 10. In a further embodiment, at least one of the supply pumps may include a housing that is formed integrally with, or that is coupled integrally with, a portion of mattress 10. In another alternative embodiment, at least one of the supply pumps would include a battery-powered source that would enable the pump to be portable. Accordingly, in such an embodiment, the same pump may be used by a patient that is moved from mattress 10 to a wheelchair (not shown), or vice-versa, that includes a seat cushion that is fabricated in accordance with the technology described herein with respect to mattress 10. In yet a further alternative embodiment, more or less than two supply pumps may be used with mattress 10.

In the exemplary embodiment, each supply pump is coupled to a single alternating control valve. In an alternative embodiment, each supply pump may be coupled to more than one control valve. For example, in one embodiment, each control valve is a multi-ported valve that is coupled to a programmable solenoid. As such, in the exemplary embodiment, the control valve may be selectively positioned to control pressurization and depressurization of those zones A, B, C, and/or D coupled in flow communication with that control valve in accordance with the operating cycle being employed. Specifically, each control valve may be selectively positioned to enable fluid to be injected through manifolds 11 and 13 and into, or discharged from, cells 62 included in zones A, B, C, or D that are being inflated and/or deflated. Moreover, in some embodiments, each control valve includes an exhaust port that is coupled to a restrictor, such as a metering valve, that enables a depressurization flow rate from zones A, B, C, and/or D to be selectively controlled in accordance with the operating cycle being employed. In another embodiment, mattress 10 uses any flow control mechanism that enables mattress 10 to function as described herein. In the exemplary embodiment, the working fluid supplied to inflatable portion 12 is air. In an alternative embodiment, the working fluid is any fluid that enables mattress 10 to function as described herein, including, but not limited to, other gases, fluids, or liquids.

FIG. 4 best illustrates manifold system 11 and FIG. 5 best illustrates manifold system 13. It should be noted that any manifold system may be used that enables mattress 10 to function as described herein, and that mattress 10 is not limited to only using manifold systems 11 and/or 13. Moreover, it should also be noted that for simplicity, FIG. 5 illustrates only a single pair of supply channels 170 coupled to zones A and B and does not illustrate the supply channels 170 that would be coupled to zones C and D in a manner similar to that shown in FIG. 4. In the exemplary embodiments, the cells 62 included with each mattress 10 are grouped in zones A, B, C, and D of clusters 112. Moreover, in the exemplary embodiment, each cluster 112 in a respective zone A, B, C, and/or D is only coupled in flow communication by channels 170 with those clusters 112 included in that zone A, B, C, and/or D.

In the exemplary embodiment, in manifold 11, each cluster 112 includes six cells 62 that are coupled together in flow communication by channels 120. More specifically, in the embodiment illustrated in FIG. 4, each cluster 112 includes a 3×2 arrangement of cells 62 that are coupled in flow communication by channels 120. In the exemplary embodiments of FIGS. 4 and 5, for simplicity, only a limited number of channels 120 are illustrated. Furthermore, in the embodiment, in manifold 13, each cluster 112 includes three cells coupled together in flow communication by channels 120. More specifically, in the embodiment illustrated in FIG. 5, the cells 62 in each cluster 112 are arranged in an L-shaped arrangement. In one alternative embodiment, each cluster 112 includes two, four, or five cells 62. In a further alternative embodiment, each cluster includes more than six cells 62. In yet another alternative embodiment, at least some of the clusters 112 in at least one zone A, B, C, and/or D include more or less cells 62 than the clusters 112 included in at least one other zone A, B, C, and/or D. Moreover, in another alternative embodiment, at least some of the clusters 112 in a specific zone A, B, C, and/or D include a different number of cells 62 than at least some of the same clusters 112 in that same zone A, B, C, and/or D. Furthermore, clusters 112 may include any number of cells 62 that are arranged in any shaped coupling arrangement, for example other than an L-shaped arrangement, that enables mattress 10 to function as described herein.

In each manifold 11 and 13, in the exemplary embodiment, clusters 112 in each zone A, B, C, and D are arranged in an alternating pattern defined by zone rows 199 and zone columns 201. More specially, in each exemplary manifold, clusters 112 are oriented in four-zoned arrangement 198 wherein the clusters 112 are arranged in a repeating ABAB zone pattern in a first zone row 200, in a repeating CDCD zone pattern in a second zone row 202, in a repeating BABA zone pattern in a third zone row 204, and in a repeating DCDC zone pattern in a fourth zone row 206, wherein each zone row 199 extends laterally between mattress sides 20 and 22. Arrangement 198 then repeats in each subsequent zone row 199 defined between fourth row 206 and mattress foot end 26. Alternatively, clusters 112 may be defined in any number of zones that enables mattress 10 to function as described herein. For example, mattress 10 may include three zones of cells 62 or more than four zones of cells 62, and is not limited to only being a four-zoned mattress.

Moreover, in the exemplary embodiment, within arrangement 198, clusters 112 are also arranged in a repeating zone pattern in zone columns 201 extending between mattress head and foot ends 24 and 26. More specifically, in the exemplary embodiment, clusters 112 are arranged in a repeating ACBD zone pattern in a first zone column 220, and in a repeating BDAC zone pattern in a second zone column 222. Arrangement 198 then repeats in each subsequent column 201 defined between second zone column 222 and mattress side 22. Alternatively, clusters 112 may be arranged in any orientation that enables mattress 10 to function as described herein, and are not limited to being oriented in zone rows 199 and/or zone columns 201. Furthermore, clusters 112 are not arranged symmetrically across mattress 10.

FIGS. 6-9 are each logic diagrams of exemplary operating cycles or operating schedules 300 that may be used with mattress 10 and with manifold systems 11 and 13. Specifically, FIG. 6 illustrates an exemplary 12 stage operating cycle 300, and FIGS. 7-9 each illustrate exemplary 8 stage operating cycles 300 in which the zones A, B, C, and D are each coupled to the supply pumps in different coupling arrangements. For example, in the operating schedule 300 illustrated in FIG. 7, zones A and B are coupled to the first supply pump through the first control valve, while in the operating schedule illustrated in FIG. 8, zones A and D are coupled to the first supply pump through the first control valve. Similarly, in the operating schedule 300 illustrated in FIG. 6, zones A and B are coupled to the first supply pump through the first control valve, while in the operating schedule 300 illustrated in FIG. 9, zones A and C are coupled to the first supply pump through the first control valve. Because the supply channels 170 are coupled via quick disconnect couplings to the supply pumps, the channels 170 may be easily interchanged to enable a different operating schedule 300 to be implemented to mattress 10.

In the exemplary embodiments, each operating cycle 300 includes a plurality of pressurization segments 310. More specifically, in the exemplary embodiment, the pressurization segments 310 in each respective operating cycle 300 are each executed for an identical amount of time. For example, in one embodiment, each pressurization segment 310 is executed for a period of about five minutes. Alternatively, each pressurization segment 310 may be executed for any amount of time that enables mattress 10 to function as described herein. Furthermore, in another embodiment, at least one pressurization segment 310 in an operating cycle 300 is executed for a different period of time than at least one pressurization segment 310 in that same cycle 300. Moreover, in one embodiment, the amount of time that each pressurization segment 310 in an operating cycle 300 is executed may be variably adjusted by the user, for example.

In the exemplary embodiment, because zones A, B, C, and D are defined across all of inflatable portion 12, mattress 10 is known as a full alternating pressure mattress. Alternatively, mattress 10 may be a partially alternating pressure mattress in which portions of the primary support area are not inflatable and/or portions of inflatable portion 12 are not included in zones A, B, C, and/or D.

During use, mattress 10 is configured to apply alternating pressure and/or vibration forces to the patient. For simplicity, the operation of mattress 10 is described herein with respect to the operating schedule 300 illustrated in FIG. 7. It should be noted that mattress 10 is not limited to only being used with the operating schedule 300 illustrated in FIG. 7 or in FIG. 6, 8, or 9, but rather any operating schedule may be used that enables mattress 10 to deliver a desired treatment and to function as described herein.

Initially mattress 10 is inflated by introducing air from the supply pumps into all of the cells 62. In the exemplary embodiment, cells 62 are initially pressurized substantially equally across mattress 62, such that each cell 62 has a generally circular cross-sectional profile when inflated. In an alternative embodiment, cells 62 have a non-circular cross-sectional profile. In the exemplary embodiment, the initial fluid pressure of each cell 62 is variably selectable by the patient based on comfort and/or prone immersion requirements, and is initially adjustable via the control valves to enable additional air to enter cells 62, or to enable the fluid pressure in cells 62 to decrease. As cells 62 are inflated, each cell 62 expands radially outward.

When all of the cells 62 are inflated, which is normally the initial operating state of mattress 10, the sides of adjacent cells 62 contact each other and form a generally continuous, but highly displaceable, supporting surface. Moreover, in the exemplary embodiment, because mattress 10 is cellular, the weight of the prone patient is distributed generally uniformly across the entire inflatable area 12, such that mattress 10 dissipates the pressures induced to the patient.

After the fluid pressure within cells 62 is substantially equalized, each cell 62 contains approximately the same fluid pressure. For example, in one embodiment, cells 62 are initially pressurized to a pressure of between approximately 20-35 mmHg. The desired operating schedule is then implemented to cause mattress 10 to induce alternating pressure and/or vibration forces to the patient. Specifically, when the supply pumps are energized and the operating schedule 300 illustrated in FIG. 7 is implemented, the control valves are automatically positioned to enable air to flow into the clusters 112 of cells 62 included in zones B and C during "pressurization segment 1". Simultaneously, as the fluid pressure of cells 62 in zones B and C is increased, the position of the control valves enables the fluid pressure in the cells 62 of zones A and D to decrease as the air is slowly exhausted to atmosphere. For example, in one embodiment, during pressurization segment 1, the fluid pressure of cells in zones B and C is increased to between approximately 20-35 mmHg and the fluid pressure in zones A and D decreases to between approximately 10-19 mmHg.

After a desired amount of time has elapsed, for example 5 minutes, the control valves are repositioned automatically to enable air to flow into the clusters 112 of cells 62 included in zones A and C during "pressurization segment 2". Simultaneously, as the fluid pressure of cells 62 in zones A and C is increased, the position of the control valves enables the fluid pressure in the cells 62 of zones B and D to decrease as the air is slowly exhausted to atmosphere. The remaining 6 pressurization segments 310, i.e., "segments (3-8)", are each implemented and if desired, the entire operating schedule 300 can then be repeated. It should be noted, in the exemplary embodiment, during implementation of each pressurization segment 310 in each operating schedule 300, the operating pressure of no more than 50% of the cells 62 in the inflatable portion is increased while the operating pressure of no more than 50% of the cells in the inflatable portion is decreased. In other embodiments, depending on, for example, the multi-zoned arrangement 110 of cells 62, the number of zones of cells 62, the size and shape of individual cells 62, the size, shape, number of cells 62 in clusters 112, and/or the number of inflatable cells 62 in inflatable portion 12 that are not zoned, the amount of cells 62 being pressurized or depressurized during each segment 310 of an operating scheme or schedule 300 may be varied or tailored to accommodate different patient needs and requirements.

As a result of the alternating pressure being induced to the patient, across the inflatable portion 12, mattress 10 promotes blood perfusion in the patient. Enhanced blood perfusion, as is known in the art, is generally considered very beneficial to burn patients and/or long-term care patients, for example. In addition, mattress 10 facilitates reducing the formation of decubitus and/or pressure ulcers to immobilized seated or prone users by providing total pressure relief across inflatable portion 12. Moreover, mattress 10 enhances the pressure control and inflation of cells supporting the patient as compared to known inflatable mattresses and cushions. More specifically, a user of mattress 10 has enhanced precision control over the inflation and pressurization of cells 62 in mattress 10 as compared to the control available in known inflatable mattresses and cushions.

More specifically, the combination of arrangement 110, zones A, B, C, and D, and manifolds 11 and 13, enables a plurality of alternating pressure operating schedules to be implemented via mattress 10 and thus, increases the flexibility of treatments available to a patient. Moreover, the cellular design of mattress 10 enables the primary support surface to essentially mold to the user and facilitates the primary support surface providing an enhanced resolution under the user's body, such that the amount of contact between the user and the support surface is facilitated to be increased, the weight of the user is facilitated to be more uniformly redistributed, and the pressure induced to the user from side-to-side and from head-to-toe is reduced to levels deemed below capillary closure pressures. Furthermore, the alternating inflation and deflation of cells 62 ensures that pressure points induced to the patient are constantly changed, such that blood circulation within the patient is enhanced as the patient is supported on air-filled cells 62. Mattress 10 is a true alternating pressure system that uses between about 7.5-10.5 liters/minute of air. As such, the patient's skin temperature and moisture levels are substantially maintained. In addition, mattress 10 provides a stable and secure support surface even to a seated user in which the support surface and mattress 10 facilitates reducing sitting fatigue induced to the seated user.

The above-described cellular mattresses/cushions provide a user with a support surface that is selectively controllable to facilitate increasing stability and comfort to the user. More specifically, the cellular cushions each include a conformal layer that includes a plurality of cells extending therefrom, wherein each cell extending from the conformal layer are selectively coupled in flow communication with other cells in a zoned configuration. The zoned configuration enables the user to receive alternating pressures induced to the support surface. As a result, a cellular cushion is provided which facilitates increasing the support and stability provided to a user in a cost-effective and reliable manner.

Exemplary embodiments of cellular mattresses/cushions are described above in detail. Although the cellular mattresses are herein described and illustrated in association with prone users, it should be understood that the present invention may be used to provide cushioning in a plurality of other uses. Moreover, it should also be noted that the components of each cellular mattress are not limited to the specific embodiments described herein, but rather, aspects of each mattress and fabrication method may be utilized independently and separately from other methods described herein.

While the invention has been described in terms of various specific embodiments, those skilled in the art will recognize that the invention can be practiced with modification within the spirit and scope of the claims.

What is claimed is:

1. A cellular structure comprising:

a base comprising a first lateral side, a second lateral side, a first axial side and a second axial side and at least a first layer and a second layer positioned between said first and second lateral sides and between said first and second axial sides;

a plurality of hollow cells coupled to said base and extending outwardly from said base, each of said cells being aligned in a plurality of rows and a plurality of columns that are substantially perpendicular to said rows, said plurality of cells grouped together in at least a first zone, a second zone, and a third zone, said first and second zones being laterally aligned between said first and second lateral sides and said first and third zones being axially aligned between said first and second axial sides, said plurality of cells in each of said first, second, and third zones are only coupled in flow communication with said plurality of cells in that respective zone;

a sealing layer coupled to at least one of said base first and second layers; and a pressurization system coupled to said first, second, and third zones for selectively pressurizing each of said zones independently of cells coupled in said other zones, said pressurization zone configured such that in at least a first mode of operation said first zone is pressurized while said second and third zones are depressurized and such that in at least a second mode of operation, said first zone is depressurized while, said second and third zones are pressurized, wherein said plurality of cells in each of said first, second, and third zones are coupled together in a plurality of clusters that include at least three adjacent cells, wherein at least two of the three adjacent cells are in the same row, and wherein within each of said clusters the three adjacent cells coupled are in fluid communication with one another by a plurality of passageways that extend between adjacent said cells within each of said clusters.

2. A cellular structure in accordance with claim 1 wherein said at least three cells are arranged in an L-shape.

3. A cellular structure in accordance with claim 2 wherein each of said plurality of passageways is coupled to at least one of said first layer and said second layer.

4. A cellular structure in accordance with claim 3 wherein each of said plurality of passageways is coupled to said base by at least one of a lamination process, a silk screening process, an adhesive process, a liquid gasket process, a spray process, and a printing process.

5. A cellular structure in accordance with claim 2 wherein each of said plurality of clusters within each of said respective first zone, second zone, and third zone are coupled together in flow communication.

6. A cellular structure in accordance with claim 1 wherein said pressurization system comprises at least a first manifold, a second manifold, and a third manifold coupled to a fluid supply source.

7. A cellular structure in accordance with claim 1 wherein said pressurization system comprises at least one control valve coupled in flow communication to each of said first zone, said second zone, and said third zone for selectively changing an operating pressure of said hollow cells in each said zone.

8. A cellular structure in accordance with claim 7 wherein said at least one control valve is coupled to a solenoid, said solenoid is programmable to selectively control an operating pressure within said plurality of cells.

9. A cellular cushion comprising:

a base comprising at least a first layer and a second layer; and a plurality of hollow cells coupled to said base and extending outwardly from said base, each of said cells being aligned in a plurality of rows and a plurality of columns that are substantially perpendicular to said rows, said plurality of cells grouped together in at least three independent zones, said plurality of cells in each of said at least three independent zones are coupled in flow communication only with said plurality of cells in that respective zone, each of said at least three independent zones comprises a plurality of clusters of at least three cells, said cells coupled together in flow communication, and said cells within each cluster are arranged in an L-shape, wherein within each of said clusters said adjacent cells are coupled together in fluid communication with one another by a plurality of passageways that extend between adjacent said cells said plurality of clusters are arranged in a spaced pattern extending across said cushion such that each of said clusters in said first zone are adjacent to each of said clusters in said second and third zones.

10. A cellular cushion in accordance with claim 9 wherein each of said plurality of clusters within each of said at least three independent zones are coupled together in flow communication only with other clusters in that respective independent zone.

11. A cellular cushion in accordance with claim 9 further comprising a pressurization system coupled in flow communication to said cushion for selectively increasing a fluid pressure within at least some of said plurality of hollow cells.

12. A cellular cushion in accordance with claim 11 wherein said pressurization system comprises a plurality of manifolds for supplying fluid from a pump to said cushion, said plurality of manifolds comprise at least one manifold coupled to each of said at least three independent zones for selectively pressurizing at least a first of said at least three independent zones independently of at least a second and a third of said at least three independent zones.

13. A cellular cushion in accordance with claim 11 wherein said pressurization system comprises a plurality of control valves for selectively controlling fluid flow to said cushion from a fluid supply source.

14. A cellular cushion in accordance with claim 13 wherein at least one of said plurality of control valves is coupled to a solenoid that is programmable to selectively control an operating pressure within said plurality of hollow cells.

15. A cellular cushion in accordance with claim 11 wherein said pressurization system is configured to selectively pressurize at least one of said at least three independent zones independently of said remaining other independent zones.

16. A cellular cushion in accordance with claim 11 wherein said pressurization system is configured to:

pressurize only two of said at least three independent zones in a first operating mode; and pressurize only one of said at least three independent zones in a second operating mode.

17. A mattress comprising:

a flexible base comprising first lateral side, a second lateral side, a first axial side and a second axial side and a plurality of layers positioned between said first and second lateral sides and between said first and second axial sides;

a plurality of zones of hollow cells coupled to at least a portion of said base in a pattern comprising at least a first zone, a second zone, and a third zone, said first and second zones being laterally aligned between said first and second lateral sides and said first and third zones being axially aligned between said first and second axial sides, said cells in said first zone are only coupled in flow communication with cells in said first zone, said cells in said second zone are only coupled in flow communication with cells in said second zone, and said cells in said third zone are only coupled in flow communication with cells in said third zone, said cells in each of said zones are arranged in a spaced pattern such that cells in said first zone are adjacent to cells in said second and third zones and such that a portion of said first zone is between a portion of said second and third zones; and a pressurization system coupled to said plurality of zones of hollow cells for selectively changing an operating pressure within said plurality of hollow cells in each of said plurality of zones independently of said plurality of hollow cells in each of said other plurality of zones, and a depressurization system coupled to said plurality of zones of hollow cells for actively depressurizing one or more of said plurality of zones of hollow cells.

18. A mattress in accordance with claim 17 wherein said plurality of cells in each of said plurality of zones are only coupled together in flow communication with cells in that respective zone by a plurality of passageways.

19. A mattress in accordance with claim 17 wherein said mattress comprises a non-inflatable portion and an inflatable portion, said plurality of zones of hollow cells are within said inflatable portion.

20. A mattress in accordance with claim 17 wherein said pressurization system comprises a plurality of manifolds for selectively changing an operating pressure of at least a portion of said cushion.

21. A mattress in accordance with claim 17 said plurality of manifolds comprise at least one manifold coupled to each of said at least three independent zones for selectively pressurizing at least a first of said at least three independent zones independently of at least a second and a third of said at least three independent zones.

22. A mattress in accordance with claim 17 wherein said pressurization system comprises a plurality of control valves for selectively controlling fluid flow to said mattress.

23. A mattress in accordance with claim 22 wherein at least one of said plurality of control valves is coupled to a programmable solenoid.

24. A cellular mattress comprising:

a base comprising first lateral side, a second lateral side, a first axial side and a second axial side and at least one layer positioned between said first and second lateral sides and between said first and second axial sides;

a plurality of hollow fluid-containing cells, each of said cells being aligned in a plurality of rows and a plurality of columns that are substantially perpendicular to said rows and coupled to said base such that said cells are coupled together in flow communication in at least a first zone, a second zone, and a third zone, said first and second zones being laterally aligned between said first and second lateral sides and said first and third zones being axially aligned between said first and second axial sides, each of said cells extends outwardly from said base, a cavity defined within each said cell in each of said zones is coupled in flow communication only with every other cell cavity in that respective zone, said plurality of cells in each of said first, second, and third zones are coupled together in a plurality of clusters including at least three adjacent cells, wherein at least two of said three adjacent cells are in the same column, and wherein for each of said clusters said three adjacent cells are coupled in fluid communication with one another by a plurality of passageways that extend between adjacent said cells; and a plurality of manifolds coupled to said base to enable a fluid pressure within said mattress to be selectively changed, said plurality of manifolds comprising at least a first manifold coupled to said first zone for controlling a fluid pressure of said cells within said first zone independently of cells in said second and third zones, a second manifold coupled to said second zone for controlling a fluid pressure of said cells within said second zone independently of cells in said first and third zones, and a third manifold coupled to said third zone for controlling a fluid pressure of said cells within said third zone independently of cells in said first and second zones.

25. A method of fabricating a mattress, said method comprising:

forming a first base layer including a plurality of hollow cells that extend outwardly from the base and aligned in a plurality of rows and a plurality of columns that are substantially perpendicular to said rows, wherein the cells are coupled together in flow communication in one of a first zone, a second zone, and a third zone such that the first and second zones are laterally aligned within the first base layer and the first and third zones are axially aligned within the first base layer;

coupling a second layer to the first layer, such that the cells in the first zone are coupled in flow communication only with cells in the first zone, such that the cells in the second zone are coupled in flow communication only with cells in the second zone, and such that cells in the third zone are coupled in flow communication only with cells in the third zone, and such that said plurality of cells in each of said first, second, and third zones are coupled together in a plurality of clusters including at least three adjacent cells such that at least two of the three adjacent cells are in the same row, wherein within each of said clusters said three adjacent cells are coupled in fluid communication with one another by a plurality of passageways that extend between said cells; and coupling at least one manifold to the base to enable a fluid pressure within the cells in the first zone to be controlled independently of the cells in the second and third zones, to enable a fluid pressure within the cells in the second zone to be controlled independently of the cells in the first and third zones, and to enable a fluid pressure within the cells in the third zone to be controlled independently of the cells in the first and second zones.

26. A method in accordance with claim 25 wherein coupling a second layer to the first layer further comprises defining a plurality of passageways that couple the cells in each respective zone together in flow communication.

27. A method in accordance with claim 25 wherein coupling a second layer to the first layer further comprises defining the plurality of passageways that couple the cells together in flow communication in clusters of at least three cells.

28. A method in accordance with claim 27 further comprising defining a plurality of passageways that couple the clusters in each respective zone together in flow communication only with the clusters in that respective zone.

29. A method in accordance with claim 25 further comprising coupling the plurality of manifolds in flow communication to a pressurization system for selectively increasing a fluid pressure within at least one of the first zone, the second zone, and the third zone.

30. A method in accordance with claim 25 further comprising coupling the plurality of manifolds in flow communication to a plurality of control valves for selectively controlling fluid flow to the mattress from a fluid supply source.

31. A method in accordance with claim 25 further comprising coupling the plurality of manifolds in flow communication to at least one solenoid that is programmable to selectively control an operating pressure within each of the first zone, the second zone, and the third zone.

32. A cellular structure comprising:

a base comprising a first lateral side, a second lateral side, a first axial side and a second axial side and at least a first layer and a second layer positioned between said first and second lateral sides and between said first and second axial sides;

a plurality of hollow cells coupled to said base and extending outwardly from said base, each of said cells being aligned in a plurality of rows and a plurality of columns that are substantially perpendicular to said rows, said plurality of cells grouped together in at least a first zone, a second zone, and a third zone, said first and second zones being laterally aligned between said first and second lateral sides and said first and third zones being axially aligned between said first and second axial sides, said plurality of cells in each of said first, second, and third zones are only coupled in flow communication with said plurality of cells in that respective zone;

a sealing layer coupled to at least one of said base first and second layers; and a pressurization system coupled to said first, second, and third zones for selectively pressurizing each of said zones independently of cells coupled in said other zones, said pressurization zone configured such that in at least a first mode of operation said first zone is pressurized while said second and third zones are depressurized and such that in at least a second mode of operation, said first zone is depressurized while said second and third zones are pressurized, wherein said plurality of cells in said first zone are arranged in a first pattern, said plurality of cells in said second zone is arranged in a second pattern and said plurality of cell in said third zone is arranged in a third pattern, and wherein said first pattern is orientated differently within said base than at least one of said second pattern and said third pattern.

33. A cellular structure comprising:

a base comprising a first lateral side, a second lateral side, a first axial side and a second axial side and at least a first layer and a second layer positioned between said first and second lateral sides and between said first and second axial sides;

a plurality of hollow cells coupled to said base and extending outwardly from said base, each of said cells being aligned in a plurality of rows and a plurality of columns that are substantially perpendicular to said rows, said plurality of cells grouped together in at least a first zone, a second zone, a third zone and a fourth zone, said first and second zones being laterally aligned between said first and second lateral sides, said third and fourth zones being laterally aligned between said first and second lateral side, said first and third zones being axially aligned between said first and second axial sides and said second and fourth zones being axially aligned between said first and second axial sides, said plurality of cells in each of said first, second, third zones and fourth zones are only coupled in flow communication with said plurality of cells in that respective zone;

a sealing layer coupled to at least one of said base first and second layers; and a pressurization system coupled to said first, second, third and fourth zones for selectively pressurizing each of said zones independently of cells coupled in said other zones, said pressurization zone configured such that in at least a first mode of operation said first and second zones are pressurized while said third and fourth zones are depressurized and such that in at least a second mode of operation, said first and second zones are depressurized while said third and fourth zones are pressurized.

* * * * *